US011749166B2

(12) United States Patent
Tao

(10) Patent No.: US 11,749,166 B2
(45) Date of Patent: Sep. 5, 2023

(54) GOA CIRCUIT AND DISPLAY PANEL THEREOF

(71) Applicant: Wuhan China Star Optoelectronics Technology Co., Ltd., Hubei (CN)

(72) Inventor: Jian Tao, Hubei (CN)

(73) Assignee: Wuhan China Star Optoelectronics Technology Co., Ltd., Wuhan (CN)

( * ) Notice: Subject to any disclaimer, the term of this patent is extended or adjusted under 35 U.S.C. 154(b) by 610 days.

(21) Appl. No.: 16/966,032

(22) PCT Filed: Apr. 22, 2020

(86) PCT No.: PCT/CN2020/086024
§ 371 (c)(1),
(2) Date: Jul. 30, 2020

(87) PCT Pub. No.: WO2021/203485
PCT Pub. Date: Oct. 14, 2021

(65) Prior Publication Data

US 2023/0154376 A1 May 18, 2023

(30) Foreign Application Priority Data

Apr. 7, 2020 (CN) ..... 202010264553.3

(51) Int. Cl.
*G09G 3/3266* (2016.01)
*G09G 3/20* (2006.01)

(52) U.S. Cl.
CPC ... *G09G 3/2092* (2013.01); *G09G 2310/0248* (2013.01); *G09G 2310/0267* (2013.01); *G09G 2310/061* (2013.01)

(58) Field of Classification Search
CPC ..... G09G 3/2092; G09G 2310/0248; G09G 2310/0267; G09G 2310/061
See application file for complete search history.

(56) References Cited

U.S. PATENT DOCUMENTS 9,711,098 B2 * 7/2017 Park ..... G09G 3/3611
10,796,656 B1 * 10/2020 Li ..... G09G 3/3696
2014/0176410 A1 * 6/2014 Ma ..... G11C 19/28 327/109
2014/0177780 A1 * 6/2014 Qi ..... G09G 5/18 377/64
2015/0054781 A1 * 2/2015 Miyamoto ..... G06F 3/0446 345/174

(Continued)

FOREIGN PATENT DOCUMENTS

CN 104464662 3/2015
CN 105206244 12/2015

(Continued)

*Primary Examiner* — Jose R Soto Lopez

(57) ABSTRACT

A gate driver on array (GOA) circuit and a display panel are provided. The GOA circuit provides a pull-up maintaining module including transistors T11, T12, and T13. In a pre-charge sub-phase t1 and an output sub-phase t2, a node Qb is at a high level to pull down a node P and turn off the transistor T13. A node K changes to the high level under control of the transistor T11. The transistor T12 is turned on, and the node Qb is keeping at the high level. A node Qa is keeping at the high level in the pre-charge sub-phase, and keeping at a bootstrap electrical level in the output sub-phase.

18 Claims, 7 Drawing Sheets

(56) References Cited

U.S. PATENT DOCUMENTS

| | | | | |
|---|---|---|---|---|
| 2015/0317954 | A1* | 11/2015 | Jang | G09G 3/3677 345/82 |
| 2016/0126948 | A1* | 5/2016 | Xiao | G06F 3/01 327/109 |
| 2016/0155409 | A1* | 6/2016 | Jeoung | G09G 3/3696 345/214 |
| 2017/0063370 | A1 | 3/2017 | Xiao | |
| 2017/0124975 | A1* | 5/2017 | Xiao | G09G 3/3677 |
| 2017/0199617 | A1* | 7/2017 | Gu | G06F 3/04164 |
| 2017/0345515 | A1* | 11/2017 | Shang | G11C 19/287 |
| 2018/0046308 | A1* | 2/2018 | Xiao | G09G 3/20 |
| 2018/0046311 | A1* | 2/2018 | Gu | G06F 3/04184 |
| 2018/0047751 | A1* | 2/2018 | Xiao | G09G 3/3648 |
| 2018/0181244 | A1* | 6/2018 | Sato | G09G 3/3677 |
| 2019/0147821 | A1* | 5/2019 | Tagawa | G06F 3/0412 345/173 |
| 2019/0378463 | A1* | 12/2019 | Chung | G09G 3/3225 |
| 2020/0020410 | A1* | 1/2020 | Du | G11C 19/28 |
| 2020/0082746 | A1* | 3/2020 | Zhang | G09G 3/3677 |
| 2021/0005124 | A1* | 1/2021 | Du | G11C 19/287 |
| 2021/0035516 | A1* | 2/2021 | Cao | G11C 19/287 |
| 2022/0189368 | A1* | 6/2022 | Kim | G09G 3/3266 |

FOREIGN PATENT DOCUMENTS

| | | |
|---|---|---|
| CN | 105976781 | 9/2016 |
| CN | 106128354 | 11/2016 |
| CN | 106128392 | 11/2016 |
| CN | 106297636 | 1/2017 |
| CN | 106782389 | 5/2017 |
| CN | 106898319 | 6/2017 |
| CN | 108319385 | 7/2018 |
| CN | 108766380 | 11/2018 |
| CN | 108962168 | 12/2018 |
| CN | 109300428 | 2/2019 |
| CN | 109410811 | 3/2019 |
| CN | 109461402 | 3/2019 |
| JP | 2019-090927 | 6/2019 |
| KR | 10-2004-0111016 | 12/2004 |

* cited by examiner

GOA CIRCUIT AND DISPLAY PANEL THEREOF

RELATED APPLICATIONS

This application is a National Phase of PCT Patent Application No. PCT/CN2020/086024 having International filing date of Apr. 22, 2020, which claims the benefit of priority of Chinese Patent Application No. 202010264553.3 filed on Apr. 7, 2020. The contents of the above applications are all incorporated by reference as if fully set forth herein in their entirety.

FIELD AND BACKGROUND OF THE INVENTION

The present disclosure relates to display technologies, and more particularly, to a gate driver on array (GOA) circuit and a display panel thereof.

A gate driver on array (GOA) technology is to integrate a gate drive circuit of a display panel on a glass substrate to form a scan driver for the display panel. GOA technology can reduce bonding processes of an external IC, reduce product cost, and is more suitable for making display products with narrow borders or no borders.

A current GOA circuit includes a plurality of cascaded GOA units, and each stage of the GOA unit corresponds to driving one stage of horizontal scanning lines. Each stage of the GOA unit mainly includes a pull-up circuit, a pull-up control circuit, a pull-down circuit, and a pull-down maintaining circuit. The pull-up circuit is mainly responsible for outputting a clock signal as a gate signal, that is, a Gate signal. The pull-up control circuit is responsible for controlling timing for turning on the pull-up circuit, and generally connected to a Gate signal passed from a previous stage GOA unit. The pull-down circuit is responsible for pulling the Gate signal down to a low potential immediately, that is, for turning off the Gate signal. The pull-down maintaining circuit is responsible for maintaining the Gate signal and a Gate signal of the pull-up circuit (usually called Q point) in an off state.

FIG. 1 is a current GOA circuit diagram, FIG. 2 is an ideal timing diagram of the current GOA circuit, and FIG. 3 is a simulation timing diagram of the current GOA circuit. Referring to FIG. 1, a display function of a touch and display driver integration (TDDI) product is suspended when a touch scan signal (touch signal) comes. At this time, a stage transmission of the GOA circuit is suspended, and a CLK is set low, but nodes Qb and Qa have to stay high for a CK high level coming until touch is over. A touch time is about 200 us to 300 us. Potentials of the node Qb and the node Qa are maintained by a capacitor C1. In a case of long-term retention, for example in the t1 and t2 stages of FIGS. 2 and 3, the capacitor C1 will leak through NT2 and NT10. The potentials of the node Qb and the node Qa will decrease with time, especially in a case of a longer holding time, voltages of the node Qb and the node Qa will fall faster. So that a bootstrap voltage of the node Qa (in t2 stage) will become low, which will affect a gate output waveform and cause images abnormality. That is, the bootstrap voltage (a gate voltage for driving a transistor T3), also the potentials of the nodes Qb and Qa will be reduced due to leakage, which will affect an amplitude of the bootstrap voltage and causes the gate output waveform to be severely distorted to cause the images to display abnormally.

SUMMARY OF THE INVENTION

In view of the above, the present disclosure provides a gate driver on array (GOA) circuit and a display panel to solve above-mentioned issues in a normal display phase when a touch scanning phase arrives, an image holding time is longer to reduce potentials of a node Qb and a node Qa, which causes the gate output waveform to be seriously distorted and causes an abnormal display of an image.

In order to achieve above-mentioned object of the present disclosure, one embodiment of the disclosure provides a gate driver on array (GOA) circuit including a plurality of cascading GOA units. Each of the GOA units includes a forward/backward scan module 100, a reset module 200, a pull-up module 300, a pull-down module 400, a voltage regulator module 500, a current leakage prevention module 500, a voltage regulator module 600, a signal control module 700, and a pull-up maintaining module 800.

The forward/back ward scan module 100 includes a first transistor T1 and a second transistor T2, a gate of the first transistor T1 is connected to an output end G(N−1) of a previous stage GOA unit, a source of the first transistor T1 is connected to a forward scan signal U2D, a drain of the first transistor T1 is electrically connected to a first node Qb, a gate of the second transistor T2 is connected to an output end G(N+1) of a next stage GOA unit, a source of the second transistor T2 is connected to a backward scan signal D2U, and a drain of the second transistor T2 is electrically connected to the first node Qb.

The reset module 200 includes a seventh transistor T7, a gate and a source of the seventh transistor T7 are both connected to a reset signal Reset, and a drain of the seventh transistor T7 is electrically connected to a second node P.

The pull-up module 300 includes a third transistor T3, a gate of the third transistor T3 is electrically connected to a pull-up node Qa, a source of the third transistor T3 is connected to a Nth clock signal CK(N), and a drain of the third transistor T3 is electrically connected to an output end G(N).

The pull-down module 400 includes a fourth transistor T4 and a tenth transistor T10, a gate of the fourth transistor T4 and a gate of the tenth transistor 10 both are electrically connected to the second node P, a source of the fourth transistor T4 and a source of the tenth transistor T10 both are connected to a first electrical level, a drain of the fourth transistor T4 is electrically connected to the output end G(N), and a drain of the tenth transistor T10 is electrically connected the first node Qb.

The current leakage prevention module 500 includes a ninth transistor T9, a gate of the ninth transistor T9 is connected to a second electrical level, a source of the ninth transistor T9 is electrically connected to the first node Qb, and a drain of the ninth transistor T9 is electrically connected to the pull-up node Qa.

The voltage regulator module 600 includes a first capacitor C1 and a second capacitor C2, one end of the first capacitor C1 is electrically connected to the first node Qb, another end of the first capacitor C1 is connected to the first electrical level, one end of the second capacitor C2 is electrically connected to the second node P, and another end of the second capacitor C2 is connected to the first electrical level.

The signal control module 700 includes a fifth transistor T5 and a sixth transistor T6, a gate of the fifth transistor T5 is electrically connected to the first node Qb, a source of the fifth transistor T5 is connected to the first electrical level, a drain of the fifth transistor T5 is electrically connected to the second node P, a gate of the sixth transistor T6 is connected to a (N+1)th clock signal CK(N+1), a source of the sixth transistor T6 is connected to the second electrical level, and a drain of the sixth transistor T6 is electrically connected to the second node P.

The pull-up maintaining module 800 includes a eleventh transistor T11, a twelfth transistor T12, and a thirteenth transistor T13, a gate and a source of the eleventh transistor T11 are connected to the second electrical level, a drain of the eleventh transistor T11 is electrically connected to a third node K, a gate of the twelfth transistor T12 is electrically connected to the third node K, a source of the twelfth transistor T12 is connected to the second electrical level, a drain of the twelfth transistor T12 is electrically connected to the first node Qb, a gate of the thirteenth transistor T13 is electrically connected to the second node P, a source of the thirteenth transistor T13 is connected to the first electrical level, and a drain of the thirteenth transistor T13 is electrically connected to the third node K.

In one embodiment of the disclosure, the GOA circuit includes a reset phase and a normal display phase.

In the reset phase, the reset signal Reset provides a single pulse signal at the second electrical level to turn on the seventh transistor T7 to set the second node P at the second electrical level, the second node P turns on the fourth transistor T4, the tenth transistor T10, and the thirteenth transistor T13 to set the output end G(N), the first node Qb, the pull-up node Qa, and the third node K at the first electrical level.

The normal display phase includes a pre-charge sub-phase t1, an output sub-phase t2, and a pull-down sub-phase t3.

In the pre-charge phase t1, the output end G(N−1) of the previous stage GOA unit or the output end G(N+1) of the next stage GOA unit provides the second electrical level to turn on the first transistor T1 or the second transistor T2 respectively to change the first node Qb and the pull-up node Qa to be at the second electrical level, to charge the first capacitor C1, and to turn on the third transistor T3 and the fifth transistor T5, and the fifth transistor T5 is turned on to change the second node P to be at the first electrical level to turn off the fourth transistor T4, the tenth transistor T10 and the thirteenth transistor T13.

In the output sub-phase t2, the output end G(N−1) of the previous stage GOA unit and the output end G(N+1) of the next stage GOA unit provide the first electrical level to turn off the first transistor T1 and the second transistor T2, when the first transistor T1 and the second transistor T2 are turned off and the third transistor T3 is turned on, the first node Qb is keeping at the second electrical level, and an electrical level of the pull-up node Qa changes from the second electrical level to a bootstrap electrical level, in the meantime, and the Nth clock signal CK(N) provides the second electrical level to output as a signal of the output end G(N) through the third transistor T3.

In the pre-charge sub-phase t1 and the output sub-phase t2, the thirteenth transistor T13 is turned off to change the third node K to the second electrical level under control of the eleventh transistor T11, and the twelfth transistor T12 is turned on accordingly to charge the first node Qb to keep the first node Qb at the second electrical level.

In the pull-down sub-phase t3, the output end G(N−1) of the previous stage GOA unit or the output end G(N+1) of the next stage GOA unit provides the second electrical level to turn on the first transistor T1 or the second transistor T2 respectively, the forward scan signal U2D or the backward scan signal D2U provides the first electrical level to the first node Qb, and the pull-up node Qa, the (N+1)th clock signal CK(N+1) turns on the sixth transistor T6 to change the second node P to be at the second electrical level and to charge the second capacitor C2, the second node P turns on the fourth transistor T4, the tenth transistor T10 and the thirteenth transistor T13 to change the output end G(N), the first node Qb, and the third node K to be at the first electrical level, and the third node K turns off the twelfth transistor T12 to stop the twelfth transistor T12 to charge the first node Qb.

Afterward, the first capacitor C1 keeps the first node Qb and the pull-up node Qa at the first electrical level to keep the third transistor T3 off, the second capacitor C2 keeps the second node P at the second electrical level to keep the fourth transistor T4 on, and the output end G(N) keeps at the first electrical level accordingly.

In one embodiment of the GOA circuit, one of the forward scan signal U2D and the backward scan signal D2U is at a high level, another one of them is at a low level.

When scanning forward, the output end G(N−1) of the previous stage GOA unit controls the first transistor T1 to turn on, and a gate of a first transistor T1 of a first stage GOA unit is connected to a starting signal STV.

When scanning backward, the output end G(N+1) of the next stage GOA unit controls the second transistor T2 to turn on, and a gate of a second transistor T2 of a last stage GOA unit is connected to the starting signal STV.

In one embodiment of the GOA circuit, all transistors in the GOA circuit are N-type thin film transistors, the first electrical level is a constant low level VGL, and the second electrical level is a constant high level VGH.

In the reset phase, the reset signal Reset provides a single high-level pulse signal to make the second node P at a high level, and the first node Qb, the pull-up node Qa, the third node K, the forward scan signal U2D, the backward scan signal D2U, the Nth clock signal CK(N), the (N+1)th clock signal CK(N+1), the output end G(N), the output end G(N−1) of the previous stage GOA unit, and the output end G(N+1) of the next stage GOA unit all are at a low level.

In the pre-charge sub-phase t1 of the normal display phase, the forward scan signal U2D is at the constant high level VGH and the backward scan signal D2U is at the constant low level VGL when scanning forward, the forward scan signal U2D is at the constant low level VGL and the backward scan signal D2U is at the constant high level VGH when scanning backward, the second node P, the Nth clock signal CK(N), the (N+1)th clock signal CK(N+1), the output end G(N), and the output end G(N+1) of the next stage GOA unit all are at the low level, and the output end G(N−1) of the previous stage GOA unit, the first node Qb, the pull-up node Qa, and the third node K all are at the high level.

In the output sub-phase t2 of the normal display phase, the second node P, the (N+1)th clock signal CK(N+1), the output end G(N−1) of the previous stage GOA unit, and the output end G(N+1) of the next stage GOA unit all are at the low level, and the first node Qb, the pull-up node Qa, the third node K, the Nth clock signal CK(N), and the output end G(N) all are at the high level.

In the pull-down sub-phase t3 of the normal display phase, the first node Qb, the pull-up node Qa, the third node K, the Nth clock signal CK(N), the output end G(N), and the output end G(N−1) of the previous stage GOA unit all are at the low level, and the second node P, the (N+1)th clock signal CK(N+1), and the output end G(N+1) of the next stage GOA unit all are at the high level.

In one embodiment of the disclosure, the GOA unit further includes an output control module 900, the output control module 900 includes an eighth transistor T8, a gate of the eighth transistor T8 is connected to a global control signal GAS, a source of the eighth transistor T8 is connected to the first electrical level, and a drain of the eighth transistor T8 is electrically connected to the output end G(N).

In one embodiment of the disclosure, the GOA circuit further includes a touch scan phase after the normal display phase.

In the touch scan phase, the global control signal GAS controls output ends G(N) of all stages of the GOA units to change to the first electrical level.

In one embodiment of the GOA circuit, all transistors in the GOA circuit are N-type thin film transistors, the global control signal GAS is at the low level in both the reset phase and the normal display phase, and at the high level in the touch scan phase.

In one embodiment of the GOA circuit, all clock signals are periodic pulse signals in the reset phase and the normal display phase, and all the clock signals are pulse signals synchronized with a touch scan signal in frequency in the touch scan phase.

In one embodiment of the disclosure, the GOA circuit includes a first clock signal CK1 and a second clock signal CK2, when the Nth clock signal CK(N) is the first clock signal CK1 and the (N+1)th clock signal CK(N+1) is the second signal CK2, in the reset phase and the normal display phase, a period of the first clock signal CK1 and a period of the second clock signal CK2 are the same, and a pulse signal of the next clock signal starts when a pulse signal of the previous clock signal is ending.

Another embodiment of the disclosure provides a display panel, including a gate driver on array (GOA) circuit, wherein the GOA circuit includes a plurality of cascading GOA units.

Each of the GOA units includes a forward/backward scan module 100, a reset module 200, a pull-up module 300, a pull-down module 400, a voltage regulator module 500, a current leakage prevention module 500, a voltage regulator module 600, a signal control module 700, and a pull-up maintaining module 800.

The forward/back ward scan module 100 includes a first transistor T1 and a second transistor T2, a gate of the first transistor T1 is connected to an output end G(N−1) of a previous stage GOA unit, a source of the first transistor T1 is connected to a forward scan signal U2D, a drain of the first transistor T1 is electrically connected to a first node Qb, a gate of the second transistor T2 is connected to an output end G(N+1) of a next stage GOA unit, a source of the second transistor T2 is connected to a backward scan signal D2U, and a drain of the second transistor T2 is electrically connected to the first node Qb.

The reset module 200 includes a seventh transistor T7, a gate and a source of the seventh transistor T7 are both connected to a reset signal Reset, and a drain of the seventh transistor T7 is electrically connected to a second node P.

The pull-up module 300 includes a third transistor T3, a gate of the third transistor T3 is electrically connected to a pull-up node Qa, a source of the third transistor T3 is connected to a Nth clock signal CK(N), and a drain of the third transistor T3 is electrically connected to an output end G(N).

The pull-down module 400 includes a fourth transistor T4 and a tenth transistor T10, a gate of the fourth transistor T4 and a gate of the tenth transistor 10 both are electrically connected to the second node P, a source of the fourth transistor T4 and a source of the tenth transistor T10 both are connected to a first electrical level, a drain of the fourth transistor T4 is electrically connected to the output end G(N), and a drain of the tenth transistor T10 is electrically connected the first node Qb.

The current leakage prevention module 500 includes a ninth transistor T9, a gate of the ninth transistor T9 is connected to a second electrical level, a source of the ninth transistor T9 is electrically connected to the first node Qb, and a drain of the ninth transistor T9 is electrically connected to the pull-up node Qa.

The voltage regulator module 600 includes a first capacitor C1 and a second capacitor C2, one end of the first capacitor C1 is electrically connected to the first node Qb, another end of the first capacitor C1 is connected to the first electrical level, one end of the second capacitor C2 is electrically connected to the second node P, and another end of the second capacitor C2 is connected to the first electrical level.

The signal control module 700 includes a fifth transistor T5 and a sixth transistor T6, a gate of the fifth transistor T5 is electrically connected to the first node Qb, a source of the fifth transistor T5 is connected to the first electrical level, a drain of the fifth transistor T5 is electrically connected to the second node P, a gate of the sixth transistor T6 is connected to a (N+1)th clock signal CK(N+1), a source of the sixth transistor T6 is connected to the second electrical level, and a drain of the sixth transistor T6 is electrically connected to the second node P.

The pull-up maintaining module 800 includes a eleventh transistor T11, a twelfth transistor T12, and a thirteenth transistor T13, a gate and a source of the eleventh transistor T11 are connected to the second electrical level, a drain of the eleventh transistor T11 is electrically connected to a third node K, a gate of the twelfth transistor T12 is electrically connected to the third node K, a source of the twelfth transistor T12 is connected to the second electrical level, a drain of the twelfth transistor T12 is electrically connected to the first node Qb, a gate of the thirteenth transistor T13 is electrically connected to the second node P, a source of the thirteenth transistor T13 is connected to the first electrical level, and a drain of the thirteenth transistor T13 is electrically connected to the third node K.

In one embodiment of the display panel, the GOA circuit includes a reset phase and a normal display phase.

In the reset phase, the reset signal Reset provides a single pulse signal at the second electrical level to turn on the seventh transistor T7 to set the second node P at the second electrical level, the second node P turns on the fourth transistor T4, the tenth transistor T10, and the thirteenth transistor T13 to set the output end G(N), the first node Qb, the pull-up node Qa, and the third node K at the first electrical level.

The normal display phase includes a pre-charge sub-phase t1, an output sub-phase t2, and a pull-down sub-phase t3.

In the pre-charge phase t1, the output end G(N−1) of the previous stage GOA unit or the output end G(N+1) of the next stage GOA unit provides the second electrical level to turn on the first transistor T1 or the second transistor T2 respectively to change the first node Qb and the pull-up node Qa to be at the second electrical level, to charge the first capacitor C1, and to turn on the third transistor T3 and the fifth transistor T5, and the fifth transistor T5 is turned on to change the second node P to be at the first electrical level to turn off the fourth transistor T4, the tenth transistor T10 and the thirteenth transistor T13.

In the output sub-phase t2, the output end G(N−1) of the previous stage GOA unit and the output end G(N+1) of the next stage GOA unit provide the first electrical level to turn off the first transistor T1 and the second transistor T2, when the first transistor T1 and the second transistor T2 are turned off and the third transistor T3 is turned on, the first node Qb is keeping at the second electrical level, and an electrical level of the pull-up node Qa changes from the second electrical level to a bootstrap electrical level, in the meantime, and the Nth clock signal CK(N) provides the second electrical level to output as a signal of the output end G(N) through the third transistor T3.

In the pre-charge sub-phase t1 and the output sub-phase t2, the thirteenth transistor T13 is turned off to change the third node K to the second electrical level under control of the eleventh transistor T11, and the twelfth transistor T12 is turned on accordingly to charge the first node Qb to keep the first node Qb at the second electrical level.

In the pull-down sub-phase t3, the output end G(N−1) of the previous stage GOA unit or the output end G(N+1) of the next stage GOA unit provides the second electrical level to turn on the first transistor T1 or the second transistor T2 respectively, the forward scan signal U2D or the backward scan signal D2U provides the first electrical level to the first node Qb, and the pull-up node Qa, the (N+1)th clock signal CK(N+1) turns on the sixth transistor T6 to change the second node P to be at the second electrical level and to charge the second capacitor C2, the second node P turns on the fourth transistor T4, the tenth transistor T10 and the thirteenth transistor T13 to change the output end G(N), the first node Qb, and the third node K to be at the first electrical level, and the third node K turns off the twelfth transistor T12 to stop the twelfth transistor T12 to charge the first node Qb.

Afterward, the first capacitor C1 keeps the first node Qb and the pull-up node Qa at the first electrical level to keep the third transistor T3 off, the second capacitor C2 keeps the second node P at the second electrical level to keep the fourth transistor T4 on, and the output end G(N) keeps at the first electrical level accordingly.

In one embodiment of the display panel, one of the forward scan signal U2D and the backward scan signal D2U is at a high level, another one of them is at a low level.

When scanning forward, the output end G(N−1) of the previous stage GOA unit controls the first transistor T1 to turn on, and a gate of a first transistor T1 of a first stage GOA unit is connected to a starting signal STV.

When scanning backward, the output end G(N+1) of the next stage GOA unit controls the second transistor T2 to turn on, and a gate of a second transistor T2 of a last stage GOA unit is connected to the starting signal STV.

In one embodiment of the display panel, all transistors in the GOA circuit are N-type thin film transistors, the first electrical level is a constant low level VGL, and the second electrical level is a constant high level VGH.

In the reset phase, the reset signal Reset provides a single high-level pulse signal to make the second node P at a high level, and the first node Qb, the pull-up node Qa, the third node K, the forward scan signal U2D, the backward scan signal D2U, the Nth clock signal CK(N), the (N+1)th clock signal CK(N+1), the output end G(N), the output end G(N−1) of the previous stage GOA unit, and the output end G(N+1) of the next stage GOA unit all are at a low level.

In the pre-charge sub-phase t1 of the normal display phase, the forward scan signal U2D is at the constant high level VGH and the backward scan signal D2U is at the constant low level VGL when scanning forward, the forward scan signal U2D is at the constant low level VGL and the backward scan signal D2U is at the constant high level VGH when scanning backward, the second node P, the Nth clock signal CK(N), the (N+1)th clock signal CK(N+1), the output end G(N), and the output end G(N+1) of the next stage GOA unit all are at the low level, and the output end G(N−1) of the previous stage GOA unit, the first node Qb, the pull-up node Qa, and the third node K all are at the high level.

In the output sub-phase t2 of the normal display phase, the second node P, the (N+1)th clock signal CK(N+1), the output end G(N−1) of the previous stage GOA unit, and the output end G(N+1) of the next stage GOA unit all are at the low level, and the first node Qb, the pull-up node Qa, the third node K, the Nth clock signal CK(N), and the output end G(N) all are at the high level.

In the pull-down sub-phase t3 of the normal display phase, the first node Qb, the pull-up node Qa, the third node K, the Nth clock signal CK(N), the output end G(N), and the output end G(N−1) of the previous stage GOA unit all are at the low level, and the second node P, the (N+1)th clock signal CK(N+1), and the output end G(N+1) of the next stage GOA unit all are at the high level.

In one embodiment of the display panel, the GOA unit further includes an output control module 900, the output control module 900 includes an eighth transistor T8, a gate of the eighth transistor T8 is connected to a global control signal GAS, a source of the eighth transistor T8 is connected to the first electrical level, and a drain of the eighth transistor T8 is electrically connected to the output end G(N).

In one embodiment of the display panel, the GOA circuit further includes a touch scan phase after the normal display phase.

In the touch scan phase, the global control signal GAS controls output ends G(N) of all stages of the GOA units to change to the first electrical level.

In one embodiment of the display panel, all transistors in the GOA circuit are N-type thin film transistors, the global control signal GAS is at the low level in both the reset phase and the normal display phase, and at the high level in the touch scan phase.

In one embodiment of the display panel, all clock signals are periodic pulse signals in the reset phase and the normal display phase, and all the clock signals are pulse signals synchronized with a touch scan signal in frequency in the touch scan phase.

In one embodiment of the display panel, the GOA circuit includes a first clock signal CK1 and a second clock signal CK2, when the Nth clock signal CK(N) is the first clock signal CK1 and the (N+1)th clock signal CK(N+1) is the second signal CK2, in the reset phase and the normal display phase, a period of the first clock signal CK1 and a period of the second clock signal CK2 are the same, and a pulse signal of the next clock signal starts when a pulse signal of the previous clock signal is ending.

In comparison with prior art, the GOA circuit provides the pull-up maintaining module 800 including the eleventh transistor T11, the twelfth transistor T12, and thirteenth transistor T13 between the forward/backward scan module 100 and the first node Qb. In the pre-charge sub-phase t1 and the output sub-phase t2 of the normal display phase, the first node Qb is at the high level to pull down the second node P and turn off the thirteenth transistor T13, the third node K changes to the high level under the control of the eleventh transistor T11, the twelfth transistor T12 is turned on, and the first node Qb is keeping at the second electrical level. The pull-up node Qa is keeping at the second electrical level in the pre-charge sub-phase t1, and keeping at the bootstrap electrical level in the output sub-phase t2. In the pull-down sub-phase t3, the second node P is pulled up to turn on the thirteenth transistor T13 when receiving a pull-down signal from the output end G(N+1) of the next stage GOA unit. The third node K is pulled down to turn off the twelfth transistor T12 to stop the twelfth transistor T12 from charging the first node Qb and to avoid from affecting a pull-down process.

DETAILED DESCRIPTION OF SPECIFIC EMBODIMENTS OF THE INVENTION

The following description of the embodiments is provided by reference to the drawings and illustrates the specific embodiments of the present disclosure. Directional terms mentioned in the present disclosure, such as "up," "down," "top," "bottom," "forward," "backward," "left," "right," "inside," "outside," "side," "peripheral," "central," "horizontal," "peripheral," "vertical," "longitudinal," "axial," "radial," "uppermost" or "lowermost," etc., are merely indicated the direction of the drawings. Therefore, the directional terms are used for illustrating and understanding of the application rather than limiting thereof.

Figure 4:
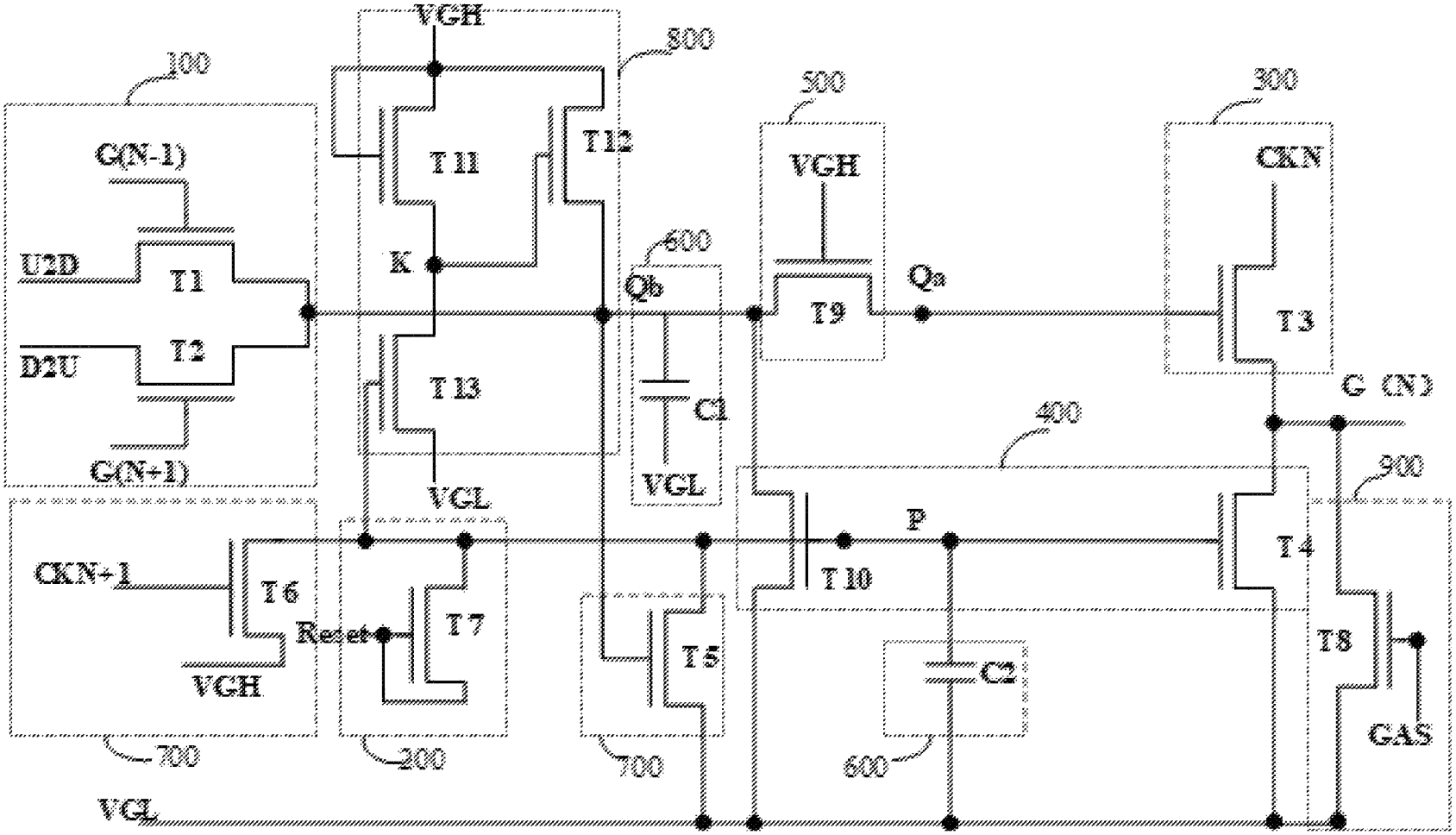
FIG. 4 is a schematic view of a circuit diagram of a GOA circuit according to an embodiment of the present disclosure.

Referring to FIG. 4, FIG. 4 is a schematic view of a circuit diagram of a gate driver on array (GOA) circuit according to an embodiment of the present disclosure. The GOA circuit including a plurality of cascading GOA units. Each of the GOA units includes a forward/backward scan module 100, a reset module 200, a pull-up module 300, a pull-down module 400, a voltage regulator module 500, a current leakage prevention module 500, a voltage regulator module 600, a signal control module 700, and a pull-up maintaining module 800.

The forward/back ward scan module 100 includes a first transistor T1 and a second transistor T2, a gate of the first transistor T1 is connected to an output end G(N−1) of a previous stage GOA unit, a source of the first transistor T1 is connected to a forward scan signal U2D, a drain of the first transistor T1 is electrically connected to a first node Qb, a gate of the second transistor T2 is connected to an output end G(N+1) of a next stage GOA unit, a source of the second transistor T2 is connected to a backward scan signal D2U, and a drain of the second transistor T2 is electrically connected to the first node Qb.

The reset module 200 includes a seventh transistor T7, a gate and a source of the seventh transistor T7 are both connected to a reset signal Reset, and a drain of the seventh transistor T7 is electrically connected to a second node P.

The pull-up module 300 includes a third transistor T3, a gate of the third transistor T3 is electrically connected to a pull-up node Qa, a source of the third transistor T3 is connected to a Nth clock signal CK(N), and a drain of the third transistor T3 is electrically connected to an output end G(N).

The pull-down module 400 includes a fourth transistor T4 and a tenth transistor T10, a gate of the fourth transistor T4 and a gate of the tenth transistor 10 both are electrically connected to the second node P, a source of the fourth transistor T4 and a source of the tenth transistor T10 both are connected to a first electrical level, a drain of the fourth transistor T4 is electrically connected to the output end G(N), and a drain of the tenth transistor T10 is electrically connected the first node Qb.

The current leakage prevention module 500 includes a ninth transistor T9, a gate of the ninth transistor T9 is connected to a second electrical level, a source of the ninth transistor T9 is electrically connected to the first node Qb, and a drain of the ninth transistor T9 is electrically connected to the pull-up node Qa.

The voltage regulator module 600 includes a first capacitor C1 and a second capacitor C2, one end of the first capacitor C1 is electrically connected to the first node Qb, another end of the first capacitor C1 is connected to the first electrical level, one end of the second capacitor C2 is electrically connected to the second node P, and another end of the second capacitor C2 is connected to the first electrical level.

The signal control module 700 includes a fifth transistor T5 and a sixth transistor T6, a gate of the fifth transistor T5 is electrically connected to the first node Qb, a source of the fifth transistor T5 is connected to the first electrical level, a drain of the fifth transistor T5 is electrically connected to the second node P, a gate of the sixth transistor T6 is connected to a (N+1)th clock signal CK(N+1), a source of the sixth transistor T6 is connected to the second electrical level, and a drain of the sixth transistor T6 is electrically connected to the second node P.

The pull-up maintaining module 800 includes a eleventh transistor T11, a twelfth transistor T12, and a thirteenth transistor T13, a gate and a source of the eleventh transistor T11 are connected to the second electrical level, a drain of the eleventh transistor T11 is electrically connected to a third node K, a gate of the twelfth transistor T12 is electrically connected to the third node K, a source of the twelfth transistor T12 is connected to the second electrical level, a drain of the twelfth transistor T12 is electrically connected to the first node Qb, a gate of the thirteenth transistor T13 is electrically connected to the second node P, a source of the thirteenth transistor T13 is connected to the first electrical level, and a drain of the thirteenth transistor T13 is electrically connected to the third node K.

In one embodiment of the disclosure, the GOA circuit includes a reset phase and a normal display phase.

In the reset phase, the reset signal Reset provides a single pulse signal at the second electrical level to turn on the seventh transistor T7 to set the second node P at the second electrical level, the second node P turns on the fourth transistor T4, the tenth transistor T10, and the thirteenth transistor T13 to set the output end G(N), the first node Qb, the pull-up node Qa, and the third node K at the first electrical level.

The normal display phase includes a pre-charge sub-phase t1, an output sub-phase t2, and a pull-down sub-phase t3.

In the pre-charge phase t1, the output end G(N−1) of the previous stage GOA unit or the output end G(N+1) of the next stage GOA unit provides the second electrical level to turn on the first transistor T1 or the second transistor T2 respectively to change the first node Qb and the pull-up node Qa to be at the second electrical level, to charge the first capacitor C1, and to turn on the third transistor T3 and the fifth transistor T5, and the fifth transistor T5 is turned on to change the second node P to be at the first electrical level to turn off the fourth transistor T4, the tenth transistor T10 and the thirteenth transistor T13.

In the output sub-phase t2, the output end G(N−1) of the previous stage GOA unit and the output end G(N+1) of the next stage GOA unit provide the first electrical level to turn off the first transistor T1 and the second transistor T2, when the first transistor T1 and the second transistor T2 are turned off and the third transistor T3 is turned on, the first node Qb is keeping at the second electrical level, and an electrical level of the pull-up node Qa changes from the second electrical level to a bootstrap electrical level, in the meantime, and the Nth clock signal CK(N) provides the second electrical level to output as a signal of the output end G(N) through the third transistor T3.

In the pre-charge sub-phase t1 and the output sub-phase t2, the thirteenth transistor T13 is turned off to change the third node K to the second electrical level under control of the eleventh transistor T11, and the twelfth transistor T12 is turned on accordingly to charge the first node Qb to keep the first node Qb at the second electrical level.

In the pull-down sub-phase t3, the output end G(N−1) of the previous stage GOA unit or the output end G(N+1) of the next stage GOA unit provides the second electrical level to turn on the first transistor T1 or the second transistor T2 respectively, the forward scan signal U2D or the backward scan signal D2U provides the first electrical level to the first node Qb, and the pull-up node Qa, the (N+1)th clock signal CK(N+1) turns on the sixth transistor T6 to change the second node P to be at the second electrical level and to charge the second capacitor C2, the second node P turns on the fourth transistor T4, the tenth transistor T10 and the thirteenth transistor T13 to change the output end G(N), the first node Qb, and the third node K to be at the first electrical level, and the third node K turns off the twelfth transistor T12 to stop the twelfth transistor T12 to charge the first node Qb.

Afterward, the first capacitor C1 keeps the first node Qb and the pull-up node Qa at the first electrical level to keep the third transistor T3 off, the second capacitor C2 keeps the second node P at the second electrical level to keep the fourth transistor T4 on, and the output end G(N) keeps at the first electrical level accordingly.

In detail, one of the forward scan signal U2D and the backward scan signal D2U is at a high level, another one of them is at a low level. When scanning forward, the output end G(N−1) of the previous stage GOA unit controls the first transistor T1 to turn on, and a gate of a first transistor T1 of a first stage GOA unit is connected to a starting signal STV. When scanning backward, the output end G(N+1) of the next stage GOA unit controls the second transistor T2 to turn on, and a gate of a second transistor T2 of a last stage GOA unit is connected to the starting signal STV.

Figure 5:
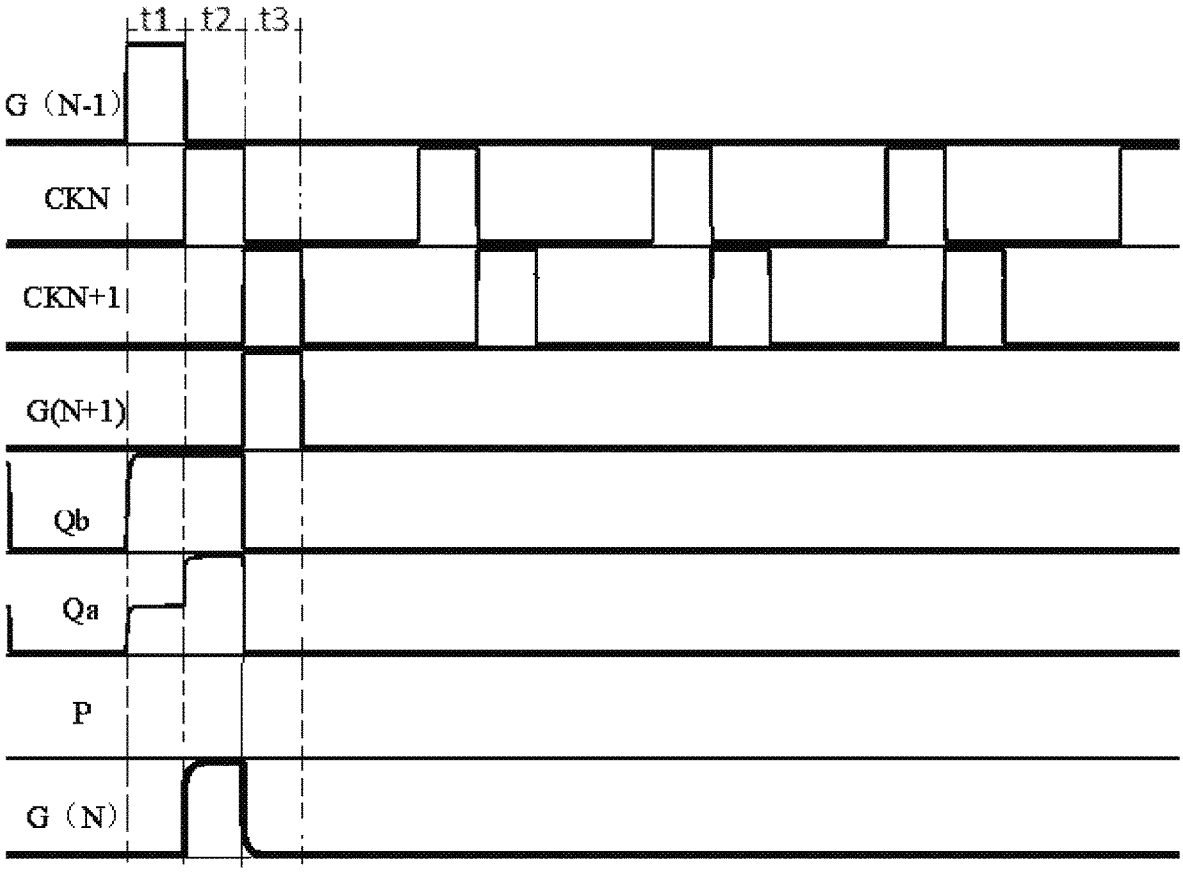
FIG. 5 is a schematic view of a simulation timing diagram of a GOA circuit according to an embodiment of the present disclosure.

FIG. 5 is a schematic view of a simulation timing diagram of a GOA circuit according to an embodiment of the present disclosure. In one embodiment of the GOA circuit in FIG. 5, all transistors in the GOA circuit are N-type thin film transistors, the first electrical level is a constant low level VGL, and the second electrical level is a constant high level VGH.

When scanning forward, the forward scan signal U2D is at the constant high level VGH, and the backward scan signal D2U is at the constant low level VGL. When scanning backward, the forward scan signal U2D is at the constant low level VGL, and the backward scan signal D2U is at the constant high level VGH (not shown in the FIG. 5). The embodiment takes the forward scan for example.

Referring to FIG. 4 and FIG. 5, a working process of the GOA circuit includes the reset phase and the normal display phase.

In the reset phase, the reset signal Reset firstly provides a single pulse signal at the high level to turn on the seventh transistor T7 to set the second node P at the high level, the second node P turns on the fourth transistor T4, the tenth transistor T10, and the thirteenth transistor T13 to pre-pull down the output end G(N), the first node Qb, the pull-up node Qa, and the third node K. An initial level of the output end G(N) is the constant low level VGL. Afterward, the reset signal Reset is setting to the low level, and the seventh transistor T7 is turned off until the normal display phase.

The normal display phase includes a pre-charge sub-phase t1, an output sub-phase t2, and a pull-down sub-phase t3.

In the pre-charge phase t1, when scanning forward, the output end G(N−1) of the previous stage GOA unit provides the high level to turn on the first transistor T1 to pull up the first node Qb and the pull-up node Qa to the constant high level VGH, to charge the first capacitor C1, and to turn on the third transistor T3 and the fifth transistor T5, and the fifth transistor T5 pulls down the second node P to the constant low level VGL to turn off the fourth transistor T4, the tenth transistor T10 and the thirteenth transistor T13.

In the output sub-phase t2, the Nth clock signal CK(N) is at the high level, the third transistor T3 output the Nth clock signal CK(N) as an output end G(N) signal. the output end G(N−1) of the previous stage GOA unit and the output end G(N+1) of the next stage GOA unit provide the low level to turn off the first transistor T1 and the second transistor T2, while the third transistor T3 is turned on. The first node Qb and the pull-up node Qa are keeping at the high level because of no leakage path. Because a parasitic capacitance of the third transistor T3, and a high level of the output end G(N) signal, an electrical level of the pull-up node Qa changes from the constant high level VGH to an even higher bootstrap electrical level by bootstrapping.

In the pre-charge sub-phase t1 and the output sub-phase t2, the thirteenth transistor T13 is turned off to change the third node K to the second electrical level under control of the eleventh transistor T11, and the twelfth transistor T12 is turned on accordingly to to keep the first node Qb at the second electrical level.

In detail, in order to prevent the high level of the pull-up node Qa from going backward to the first node Qb when the pull-up node Qa is bootstrapping to the high level, a current leakage prevention module 500 is provided between the first node Qb and the pull-up node Qa. The current leakage prevention module 500 includes a twelfth transistor T12, a gate of the twelfth transistor T12 is connected to a constant high level VGH to keep the twelfth transistor T12 turning on. When the first node Qb is at the constant high level VGH, the twelfth transistor T12 is acting as a diode conducting from the first node Qb to the pull-up node Qa to prevent the electrical level of the pull-up node Qa from going backward to the first node Qb when an electrical level of the pull-up node Qa is greater than an electrical level of the first node Qb, and then keep the bootstrapping high level of the pull-up node Qa.

In the pull-down sub-phase t3, the output end G(N+1) of the next stage GOA unit provides the high level to turn on the first transistor T1 or the second transistor T2, the backward scan signal D2U provides the low level to the first node Qb, and the pull-up node Qa, the (N+1)th clock signal CK(N+1) provides the high level to turn on the sixth transistor T6 to change the second node P to the constant high level VGH and to charge the second capacitor C2, the second node P turns on the fourth transistor T4, the tenth transistor T10 and the thirteenth transistor T13 to change the output end G(N), the first node Qb, pull-up node Qa, and the third node K to the constant low level VGL, and the pulled-down third node K turns off the twelfth transistor T12 to stop the twelfth transistor T12 to charge the first node Qb.

Afterward, the first capacitor C1 keeps the first node Qb and the pull-up node Qa at the constant low level VGL to keep the third transistor T3 off, the second capacitor C2 keeps the second node P at the constant high level VGH to keep the fourth transistor T4 on, and the output end G(N) keeps at the constant low level VGL accordingly.

The GOA circuit of the embodiment of the disclosure provides the pull-up maintaining module 800 including the eleventh transistor T11, the twelfth transistor T12, and thirteenth transistor T13 between the forward/backward scan module 100 and the first node Qb. In the pre-charge sub-phase t1 and the output sub-phase t2 of the normal display phase, the first node Qb is at the high level to pull down the second node P and turn off the thirteenth transistor T13, the third node K changes to the high level under the control of the eleventh transistor T11, the twelfth transistor T12 is turned on, and the first node Qb is keeping at the second electrical level. The pull-up node Qa is keeping at the second electrical level in the pre-charge sub-phase t1, and keeping at the bootstrap electrical level in the output sub-phase t2. In the pull-down sub-phase t3, the second node P is pulled up to turn on the thirteenth transistor T13 when receiving a pull-down signal from the output end G(N+1) of the next stage GOA unit. The third node K is pulled down to turn off the twelfth transistor T12 to stop the twelfth transistor T12 from charging the first node Qb and to avoid from affecting a pull-down process.

Figure 1:
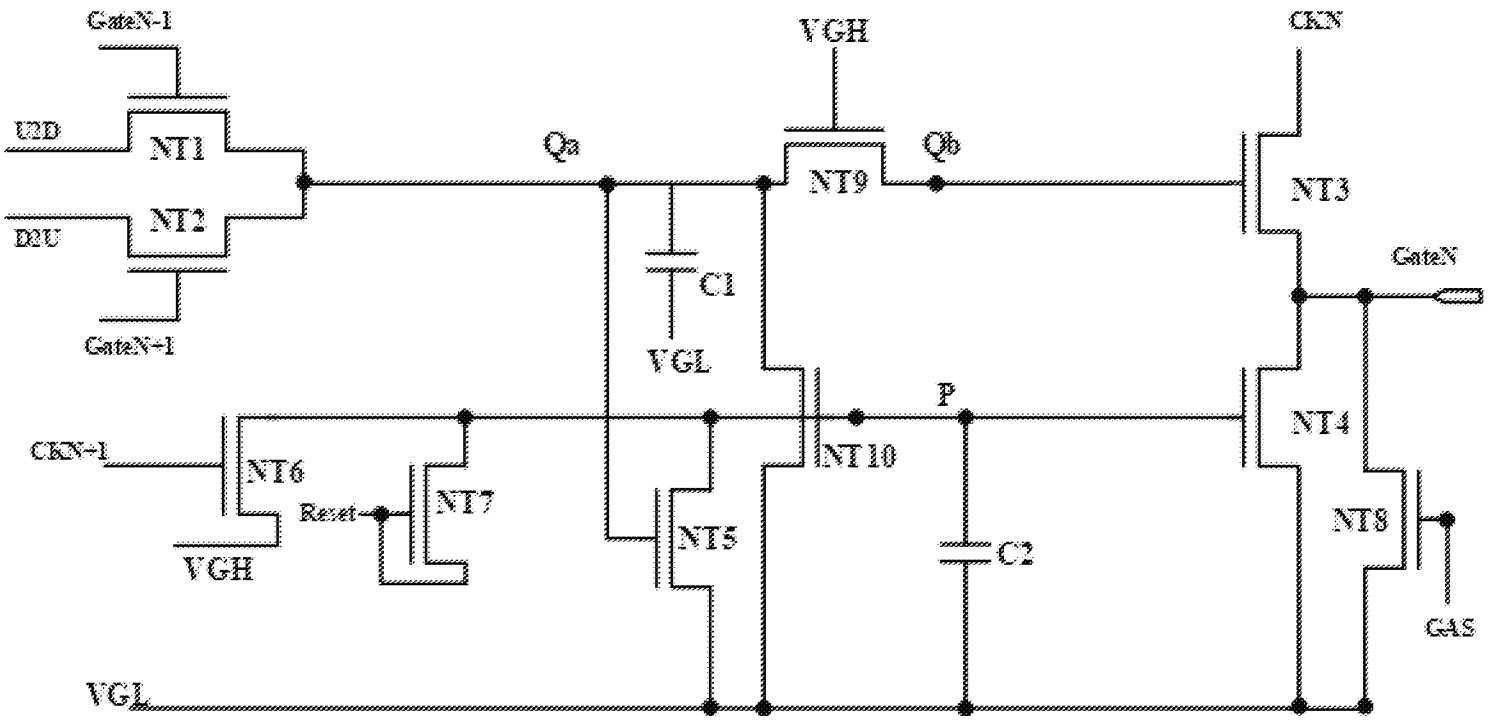
FIG. 1 is a schematic view of a circuit diagram of a current gate driver on array (GOA) circuit according to prior art.
Figure 2:
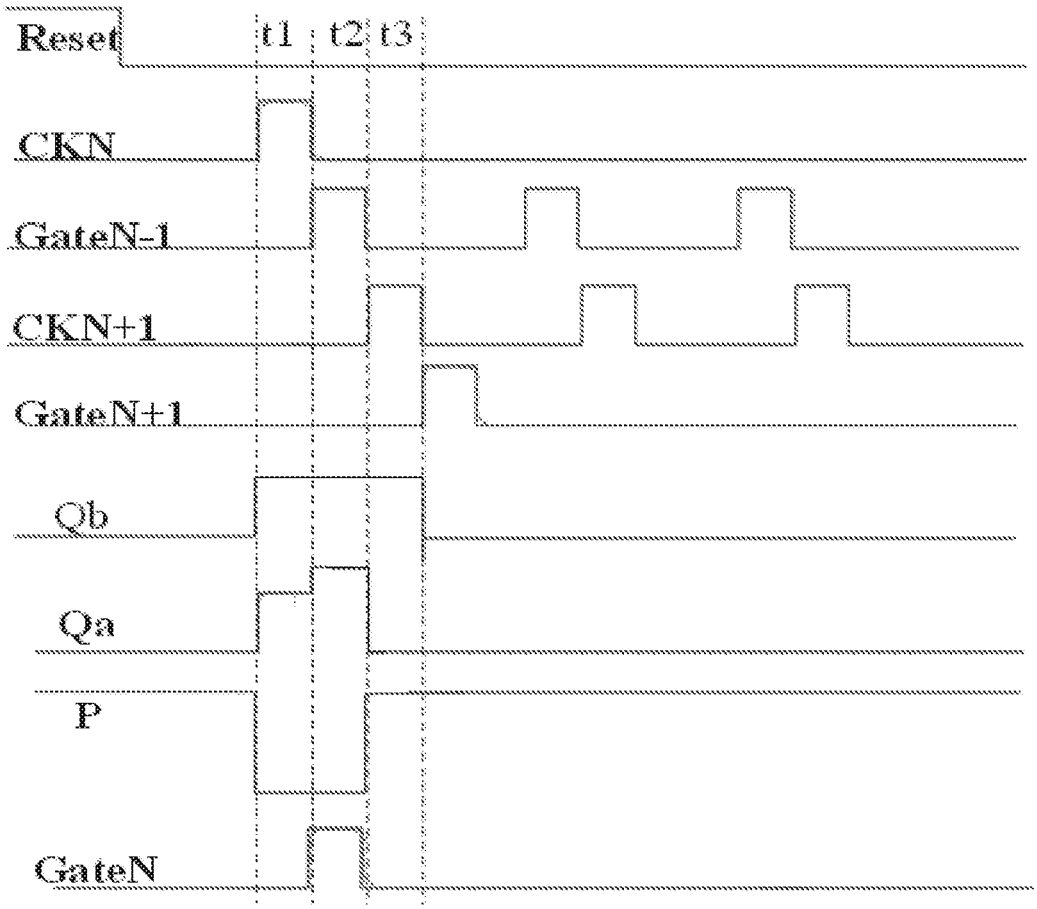
FIG. 2 is a schematic view of an ideal timing diagram of the current GOA circuit according to prior art.
Figure 3:
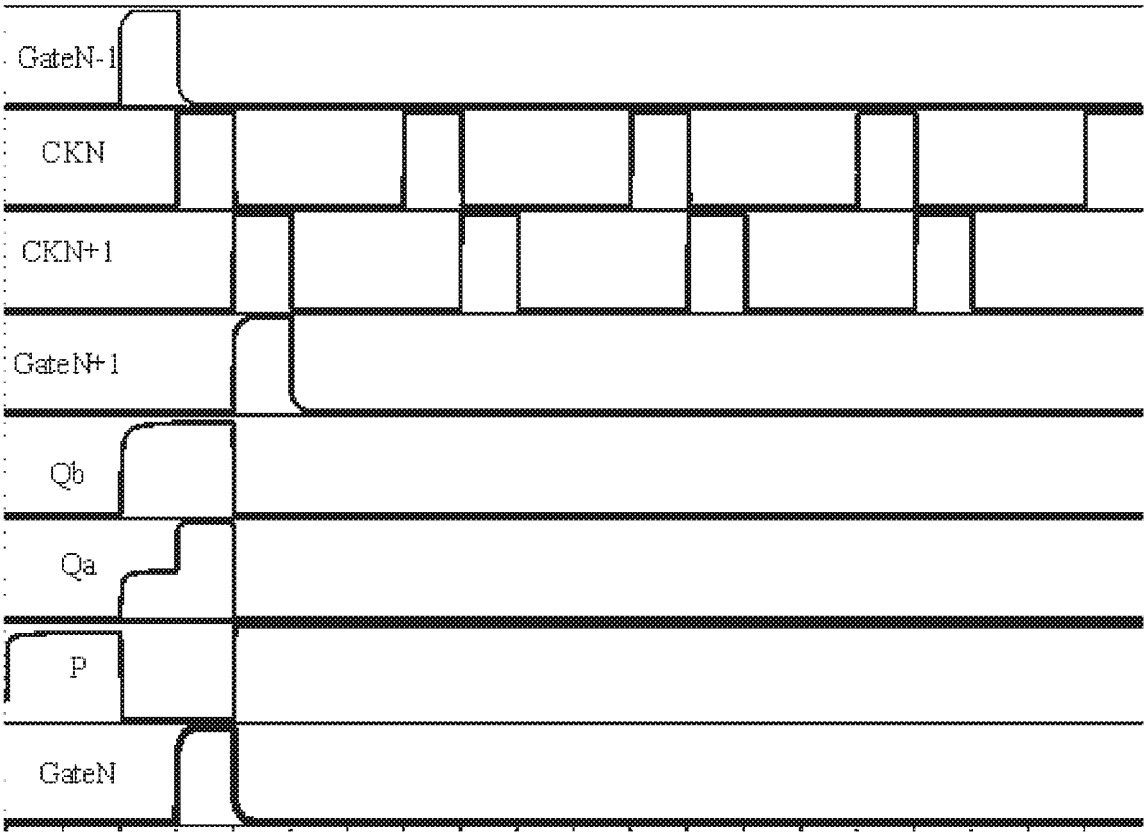
FIG. 3 is a schematic view of a simulation timing diagram of the current GOA circuit according to prior art.
Figure 6:
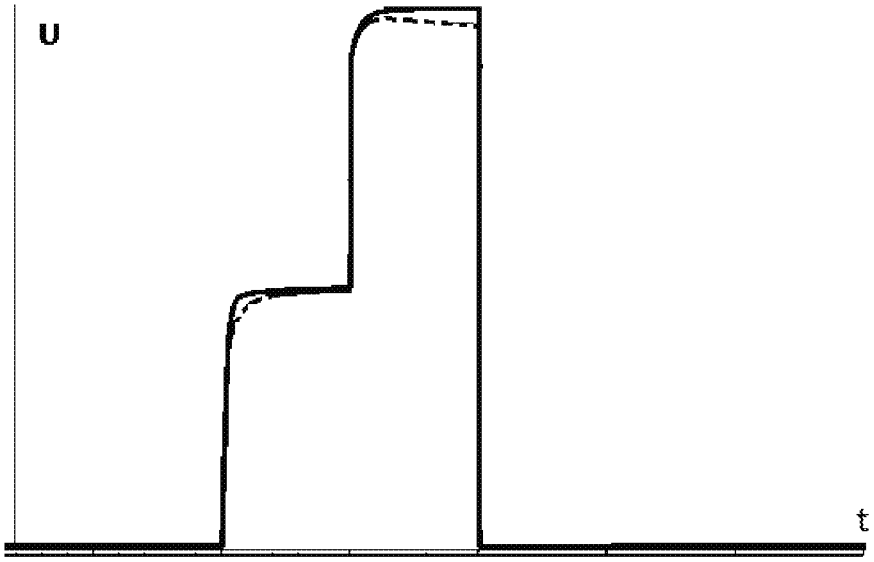
FIG. 6 is a schematic view of a simulation comparation diagram of a pull-up node Qa between a current GOA circuit and a GOA circuit in an embodiment of the present disclosure when a holding time is zero.
Figure 7:
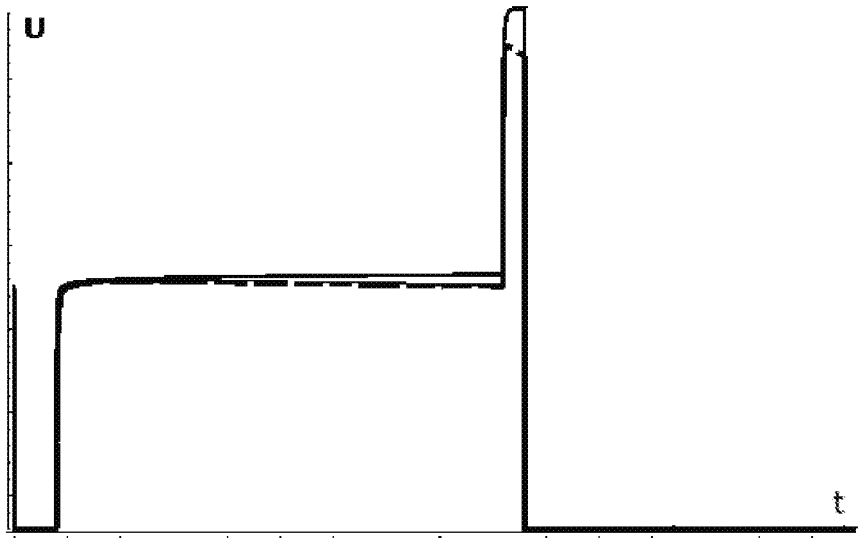
FIG. 7 is a schematic view of a simulation comparation diagram of a pull-up node Qa between a current GOA circuit and a GOA circuit in an embodiment of the present disclosure when a holding time is 200 micro-seconds.

For example, comparing an original output waveform of the pull-up node Qa (waveform of the pull-up node Qa in FIG. 3) in the pre-charge sub-phase t1 and the output sub-phase t2 with an output waveform of the embodiment (waveform of the pull-up node Qa in FIG. 5) at 0 holding time and 200 micro-seconds holding time when receiving a touch signal in the normal display phase to obtain FIG. 6 and FIG. 7. FIG. 6 is a schematic view of a simulation comparation diagram of a pull-up node Qa between a current GOA circuit and a GOA circuit in the embodiment of the present disclosure when a holding time is zero. FIG. 7 is a schematic view of a simulation comparation diagram of a pull-up node Qa between a current GOA circuit and a GOA circuit in the embodiment of the present disclosure when a holding time is 200 micro-seconds. The broken curve line is the original output waveform of the pull-up node Qa, and the solid curve line is the output waveform of the pull-up node Qa in the embodiment of the present disclosure.

Referring to FIG. 6 and FIG. 7, an amplitude the output waveform of the embodiment is greater than an amplitude of the original waveform in the pre-charge sub-phase and in the output sub-phase. The original waveform is weak in a charging process in the pre-charge sub-phase t1. A bootstrap electrical level appears a behavior of voltage dropping in the output sub-phase t2. In the long hold time case, a level of the pull-up node Qa continues dropping down for a degree of 0.5 V and affects the bootstrap electrical level.

Referring to FIG. 4, in one embodiment of the disclosure, the GOA unit further includes an output control module 900, the output control module 900 includes an eighth transistor T8, a gate of the eighth transistor T8 is connected to a global control signal GAS, a source of the eighth transistor T8 is connected to the first electrical level, and a drain of the eighth transistor T8 is electrically connected to the output end G(N).

In one embodiment of the disclosure, the GOA circuit further includes a touch scan phase after the normal display phase.

In the touch scan phase, the global control signal GAS controls output ends G(N) of all stages of the GOA units to change to the first electrical level. This is an All-gate-off function to stop cascading of the output end G(N) signals of all stages of the GOA units in the touch scan phase to prevent from interference between a scan driving signal and a touch signal.

In one embodiment of the GOA circuit, all transistors in the GOA circuit are N-type thin film transistors. The eighth transistor T8 is N-type thin film transistor. The global control signal GAS is at the low level in both the reset phase and the normal display phase, and at the high level in the touch scan phase.

In one embodiment of the GOA circuit, all clock signals are periodic pulse signals in the reset phase and the normal display phase, and all the clock signals are pulse signals synchronized with a touch scan signal in frequency in the touch scan phase.

In one embodiment of the disclosure, the GOA circuit includes a first clock signal CK1 and a second clock signal CK2, when the Nth clock signal CK(N) is the first clock signal CK1 and the (N+1)th clock signal CK(N+1) is the second signal CK2, in the reset phase and the normal display phase, a period of the first clock signal CK1 and a period of the second clock signal CK2 are the same, and a pulse signal of the next clock signal starts when a pulse signal of the previous clock signal is ending.

Another embodiment of the disclosure provides a display panel, including an abovementioned GOA circuit. The display panel has the same structure and beneficial effects as the GOA circuit provided by the foregoing embodiment. Since the foregoing embodiment has described the structure and beneficial effects of the GOA circuit in detail, it will not be repeated here.

The present disclosure of GOA circuit has been described by the above embodiments, but the embodiments are merely examples for implementing the present disclosure. It must be noted that the embodiments do not limit the scope of the invention. In contrast, modifications and equivalent arrangements are intended to be included within the scope of the invention.

What is claimed is:

1. A gate driver on array (GOA) circuit, comprising a plurality of cascading GOA units, wherein each of the GOA units comprises: a forward/backward scan module (100), a reset module (200), a pull-up module (300), a pull-down module (400), a current leakage prevention module (500), a voltage regulator module (600), a signal control module (700), and a pull-up maintaining module (800);

the forward/back ward scan module (100) comprises a first transistor (T1) and a second transistor (T2), a gate of the first transistor (T1) is connected to an output end G(N−1) of a previous stage GOA unit, a source of the first transistor (T1) is connected to a forward scan signal (U2D), a drain of the first transistor (T1) is electrically connected to a first node (Qb), a gate of the second transistor (T2) is connected to an output end G(N+1) of a next stage GOA unit, a source of the second transistor (T2) is connected to a backward scan signal (D2U), and a drain of the second transistor (T2) is electrically connected to the first node (Qb);

the reset module (200) comprises a seventh transistor (T7), a gate and a source of the seventh transistor (T7) are both connected to a reset signal (Reset), and a drain of the seventh transistor (T7) is electrically connected to a second node (P);

the pull-up module (300) comprises a third transistor (T3), a gate of the third transistor (T3) is electrically connected to a pull-up node (Qa), a source of the third transistor (T3) is connected to a Nth clock signal (CK(N)), and a drain of the third transistor (T3) is electrically connected to an output end (G(N));

the pull-down module (400) comprises a fourth transistor (T4) and a tenth transistor (T10), a gate of the fourth transistor (T4) and a gate of the tenth transistor (10) both are electrically connected to the second node (P), a source of the fourth transistor (T4) and a source of the tenth transistor (T10) both are connected to a first electrical level, a drain of the fourth transistor (T4) is electrically connected to the output end (G(N)), and a drain of the tenth transistor (T10) is electrically connected the first node (Qb);

the current leakage prevention module (500) comprises a ninth transistor (T9), a gate of the ninth transistor (T9) is connected to a second electrical level, a source of the ninth transistor (T9) is electrically connected to the first node (Qb), and a drain of the ninth transistor (T9) is electrically connected to the pull-up node (Qa);

the voltage regulator module (600) comprises a first capacitor C1 and a second capacitor C2, one end of the first capacitor C1 is electrically connected to the first node (Qb), another end of the first capacitor C1 is connected to the first electrical level, one end of the second capacitor C2 is electrically connected to the second node (P), and another end of the second capacitor C2 is connected to the first electrical level;

the signal control module (700) comprises a fifth transistor (T5) and a sixth transistor (T6), a gate of the fifth transistor (T5) is electrically connected to the first node (Qb), a source of the fifth transistor (T5) is connected to the first electrical level, a drain of the fifth transistor (T5) is electrically connected to the second node (P), a gate of the sixth transistor (T6) is connected to a (N+1)th clock signal (CK(N+1)), a source of the sixth transistor (T6) is connected to the second electrical level, and a drain of the sixth transistor (T6) is electrically connected to the second node (P); and the pull-up maintaining module (800) comprises a eleventh transistor (T11), a twelfth transistor (T12), and a thirteenth transistor (T13), a gate and a source of the eleventh transistor (T11) are connected to the second electrical level, a drain of the eleventh transistor (T11) is electrically connected to a third node (K), a gate of the twelfth transistor (T12) is electrically connected to the third node (K), a source of the twelfth transistor (T12) is connected to the second electrical level, a drain of the twelfth transistor (T12) is electrically connected to the first node (Qb), a gate of the thirteenth transistor (T13) is electrically connected to the second node (P), a source of the thirteenth transistor (T13) is connected to the first electrical level, and a drain of the thirteenth transistor (T13) is electrically connected to the third node (K).

2. The GOA circuit according to claim 1, wherein the GOA circuit comprises a reset phase and a normal display phase;

in the reset phase, the reset signal (Reset) provides a single pulse signal at the second electrical level to turn on the seventh transistor (T7) to set the second node (P) at the second electrical level, the second node (P) turns on the fourth transistor (T4), the tenth transistor (T10), and the thirteenth transistor (T13) to set the output end (G(N)), the first node (Qb), the pull-up node (Qa), and the third node (K) at the first electrical level;

the normal display phase comprises a pre-charge sub-phase (t1), an output sub-phase (t2), and a pull-down sub-phase (t3);

in the pre-charge phase (t1), the output end G(N−1) of the previous stage GOA unit or the output end (G(N+1)) of the next stage GOA unit provides the second electrical level to turn on the first transistor (T1) or the second transistor (T2) respectively to change the first node (Qb) and the pull-up node (Qa) to be at the second electrical level, to charge the first capacitor C1, and to turn on the third transistor (T3) and the fifth transistor (T5), and the fifth transistor (T5) is turned on to change the second node (P) to be at the first electrical level to turn off the fourth transistor (T4), the tenth transistor (T10) and the thirteenth transistor (T13);

in the output sub-phase (t2), the output end G(N−1) of the previous stage GOA unit and the output end (G(N+1)) of the next stage GOA unit provide the first electrical level to turn off the first transistor (T1) and the second transistor (T2), when the first transistor (T1) and the second transistor (T2) are turned off and the third transistor (T3) is turned on, the first node (Qb) is keeping at the second electrical level, and an electrical level of the pull-up node (Qa) changes from the second electrical level to a bootstrap electrical level, in the meantime, and the Nth clock signal (CK(N)) provides the second electrical level to output as a signal of the output end (G(N)) through the third transistor (T3);

in the pre-charge sub-phase (t1) and the output sub-phase (t2), the thirteenth transistor (T13) is turned off to change the third node (K) to the second electrical level under control of the eleventh transistor (T11), and the twelfth transistor (T12) is turned on accordingly to charge the first node (Qb) to keep the first node (Qb) at the second electrical level;

in the pull-down sub-phase (t3), the output end G(N−1) of the previous stage GOA unit or the output end (G(N+1)) of the next stage GOA unit provides the second electrical level to turn on the first transistor (T1) or the second transistor (T2) respectively, the forward scan signal (U2D) or the backward scan signal (D2U) provides the first electrical level to the first node (Qb), and the pull-up node (Qa), the (N+1)th clock signal CK(N+1) turns on the sixth transistor (T6) to change the second node (P) to be at the second electrical level and to charge the second capacitor C2, the second node (P) turns on the fourth transistor (T4), the tenth transistor (T10) and the thirteenth transistor (T13) to change the output end (G(N)), the first node (Qb), and the third node (K) to be at the first electrical level, and the third node (K) turns off the twelfth transistor (T12) to stop the twelfth transistor (T12) to charge the first node (Qb); and then the first capacitor C1 keeps the first node (Qb) and the pull-up node (Qa) at the first electrical level to keep the third transistor (T3) off, the second capacitor C2 keeps the second node (P) at the second electrical level to keep the fourth transistor (T4) on, and the output end (G(N)) keeps at the first electrical level accordingly.

3. The GOA circuit according to claim 2, wherein one of the forward scan signal (U2D) and the backward scan signal (D2U) is at a high level, another one of them is at a low level;

when scanning forward, the output end G(N−1) of the previous stage GOA unit controls the first transistor (T1) to turn on, and a gate of a first transistor (T1) of a first stage GOA unit is connected to a starting signal (STV); and when scanning backward, the output end (G(N+1)) of the next stage GOA unit controls the second transistor (T2) to turn on, and a gate of a second transistor (T2) of a last stage GOA unit is connected to the starting signal (STV).

4. The GOA circuit according to claim 2, wherein all transistors in the GOA circuit are N-type thin film transistors, the first electrical level is a constant low level (VGL), and the second electrical level is a constant high level (VGH);

in the reset phase, the reset signal (Reset) provides a single high-level pulse signal to make the second node (P) at a high level, and the first node (Qb), the pull-up node (Qa), the third node (K), the forward scan signal (U2D), the backward scan signal (D2U), the Nth clock signal (CK(N)), the (N+1)th clock signal (CK(N+1)), the output end (G(N)), the output end (G(N−1)) of the previous stage GOA unit, and the output end G(N+1) of the next stage GOA unit all are at a low level;

in the pre-charge sub-phase (t1) of the normal display phase, the forward scan signal (U2D) is at the constant high level (VGH) and the backward scan signal (D2U) is at the constant low level (VGL) when scanning forward, the forward scan signal (U2D) is at the constant low level (VGL) and the backward scan signal (D2U) is at the constant high level (VGH) when scanning backward, the second node (P), the Nth clock signal (CK(N)), the (N+1)th clock signal CK(N+1), the output end (G(N)), and the output end G(N+1) of the next stage GOA unit all are at the low level, and the output end G(N−1) of the previous stage GOA unit, the first node (Qb), the pull-up node (Qa), and the third node (K) all are at the high level;

in the output sub-phase (t2) of the normal display phase, the second node (P), the (N+1)th clock signal (CK(N+1)), the output end (G(N−1)) of the previous stage GOA unit, and the output end (G(N+1)) of the next stage GOA unit all are at the low level, and the first node (Qb), the pull-up node (Qa), the third node (K), the Nth clock signal (CK(N)), and the output end (G(N)) all are at the high level; and in the pull-down sub-phase (t3) of the normal display phase, the first node (Qb), the pull-up node (Qa), the third node (K), the Nth clock signal (CK(N)), the output end (G(N)), and the output end (G(N−1)) of the previous stage GOA unit all are at the low level, and the second node (P), the (N+1)th clock signal (CK(N+1)), and the output end (G(N+1)) of the next stage GOA unit all are at the high level.

5. The GOA circuit according to claim 2, wherein the GOA unit further comprises an output control module (900), the output control module (900) comprises an eighth transistor (T8), a gate of the eighth transistor (T8) is connected to a global control signal (GAS), a source of the eighth transistor (T8) is connected to the first electrical level, and a drain of the eighth transistor (T8) is electrically connected to the output end (G(N)).

6. The GOA circuit according to claim 5, wherein the GOA circuit further comprises a touch scan phase after the normal display phase; and in the touch scan phase, the global control signal (GAS) controls output ends (G(N)) of all stages of the GOA units to change to the first electrical level.

7. The GOA circuit according to claim 6, wherein all transistors in the GOA circuit are N-type thin film transistors, the global control signal (GAS) is at the low level in both the reset phase and the normal display phase, and at the high level in the touch scan phase.

8. The GOA circuit according to claim 6, wherein all clock signals are periodic pulse signals in the reset phase and the normal display phase, and all the clock signals are pulse signals synchronized with a touch scan signal in frequency in the touch scan phase.

9. The GOA circuit according to claim 8, wherein the GOA circuit comprises a first clock signal (CK1) and a second clock signal (CK2), when the Nth clock signal (CK(N)) is the first clock signal (CK1) and the (N+1)th clock signal (CK(N+1)) is the second signal (CK2), in the reset phase and the normal display phase, a period of the first clock signal (CK1) and a period of the second clock signal (CK2) are the same, and a pulse signal of the next clock signal starts when a pulse signal of the previous clock signal is ending.

10. A display panel, comprising a gate driver on array (GOA) circuit, wherein the GOA circuit comprises a plurality of cascading GOA units;

each of the GOA units comprises: a forward/backward scan module (100), a reset module (200), a pull-up module (300), a pull-down module (400), a current leakage prevention module (500), a voltage regulator module (600), a signal control module (700), and a pull-up maintaining module (800);

the forward/back ward scan module (100) comprises a first transistor (T1) and a second transistor (T2), a gate of the first transistor (T1) is connected to an output end G(N−1) of a previous stage GOA unit, a source of the first transistor (T1) is connected to a forward scan signal (U2D), a drain of the first transistor (T1) is electrically connected to a first node (Qb), a gate of the second transistor (T2) is connected to an output end G(N+1) of a next stage GOA unit, a source of the second transistor (T2) is connected to a backward scan signal (D2U), and a drain of the second transistor (T2) is electrically connected to the first node (Qb);

the reset module (200) comprises a seventh transistor (T7), a gate and a source of the seventh transistor (T7) are both connected to a reset signal (Reset), and a drain of the seventh transistor (T7) is electrically connected to a second node (P);

the pull-up module (300) comprises a third transistor (T3), a gate of the third transistor (T3) is electrically connected to a pull-up node (Qa), a source of the third transistor (T3) is connected to a Nth clock signal (CK(N)), and a drain of the third transistor (T3) is electrically connected to an output end (G(N));

the pull-down module (400) comprises a fourth transistor (T4) and a tenth transistor (T10), a gate of the fourth transistor (T4) and a gate of the tenth transistor (10) both are electrically connected to the second node (P), a source of the fourth transistor (T4) and a source of the tenth transistor (T10) both are connected to a first electrical level, a drain of the fourth transistor (T4) is electrically connected to the output end (G(N)), and a drain of the tenth transistor (T10) is electrically connected the first node (Qb);

the current leakage prevention module (500) comprises a ninth transistor (T9), a gate of the ninth transistor (T9) is connected to a second electrical level, a source of the ninth transistor (T9) is electrically connected to the first node (Qb), and a drain of the ninth transistor (T9) is electrically connected to the pull-up node (Qa);

the voltage regulator module (600) comprises a first capacitor C1 and a second capacitor C2, one end of the first capacitor C1 is electrically connected to the first node (Qb), another end of the first capacitor C1 is connected to the first electrical level, one end of the second capacitor C2 is electrically connected to the second node (P), and another end of the second capacitor C2 is connected to the first electrical level;

the signal control module (700) comprises a fifth transistor (T5) and a sixth transistor (T6), a gate of the fifth transistor (T5) is electrically connected to the first node (Qb), a source of the fifth transistor (T5) is connected to the first electrical level, a drain of the fifth transistor (T5) is electrically connected to the second node (P), a gate of the sixth transistor (T6) is connected to a (N+1)th clock signal (CK(N+1)), a source of the sixth transistor (T6) is connected to the second electrical level, and a drain of the sixth transistor (T6) is electrically connected to the second node (P); and the pull-up maintaining module (800) comprises a eleventh transistor (T11), a twelfth transistor (T12), and a thirteenth transistor (T13), a gate and a source of the eleventh transistor (T11) are connected to the second electrical level, a drain of the eleventh transistor (T11) is electrically connected to a third node (K), a gate of the twelfth transistor (T12) is electrically connected to the third node (K), a source of the twelfth transistor (T12) is connected to the second electrical level, a drain of the twelfth transistor (T12) is electrically connected to the first node (Qb), a gate of the thirteenth transistor (T13) is electrically connected to the second node (P), a source of the thirteenth transistor (T13) is connected to the first electrical level, and a drain of the thirteenth transistor (T13) is electrically connected to the third node (K).

11. The display panel according to claim 10, wherein the GOA circuit comprises a reset phase and a normal display phase;

in the reset phase, the reset signal (Reset) provides a single pulse signal at the second electrical level to turn on the seventh transistor (T7) to set the second node (P) at the second electrical level, the second node (P) turns on the fourth transistor (T4), the tenth transistor (T10), and the thirteenth transistor (T13) to set the output end (G(N)), the first node (Qb), the pull-up node (Qa), and the third node (K) at the first electrical level;

the normal display phase comprises a pre-charge sub-phase (t1), an output sub-phase (t2), and a pull-down sub-phase (t3);

in the pre-charge phase (t1), the output end G(N−1) of the previous stage GOA unit or the output end (G(N+1)) of the next stage GOA unit provides the second electrical level to turn on the first transistor (T1) or the second transistor (T2) respectively to change the first node (Qb) and the pull-up node (Qa) to be at the second electrical level, to charge the first capacitor C1, and to turn on the third transistor (T3) and the fifth transistor (T5), and the fifth transistor (T5) is turned on to change the second node (P) to be at the first electrical level to turn off the fourth transistor (T4), the tenth transistor (T10) and the thirteenth transistor (T13);

in the output sub-phase (t2), the output end G(N−1) of the previous stage GOA unit and the output end (G(N+1)) of the next stage GOA unit provide the first electrical level to turn off the first transistor (T1) and the second transistor (T2), when the first transistor (T1) and the second transistor (T2) are turned off and the third transistor (T3) is turned on, the first node (Qb) is keeping at the second electrical level, and an electrical level of the pull-up node (Qa) changes from the second electrical level to a bootstrap electrical level, in the meantime, and the Nth clock signal (CK(N)) provides the second electrical level to output as a signal of the output end (G(N)) through the third transistor (T3);

in the pre-charge sub-phase (t1) and the output sub-phase (t2), the thirteenth transistor (T13) is turned off to change the third node (K) to the second electrical level under control of the eleventh transistor (T11), and the twelfth transistor (T12) is turned on accordingly to charge the first node (Qb) to keep the first node (Qb) at the second electrical level;

in the pull-down sub-phase (t3), the output end G(N−1) of the previous stage GOA unit or the output end (G(N+1)) of the next stage GOA unit provides the second electrical level to turn on the first transistor (T1) or the second transistor (T2) respectively, the forward scan signal (U2D) or the backward scan signal (D2U) provides the first electrical level to the first node (Qb), and the pull-up node (Qa), the (N+1)th clock signal CK(N+1) turns on the sixth transistor (T6) to change the second node (P) to be at the second electrical level and to charge the second capacitor C2, the second node (P) turns on the fourth transistor (T4), the tenth transistor (T10) and the thirteenth transistor (T13) to change the output end (G(N)), the first node (Qb), and the third node (K) to be at the first electrical level, and the third node (K) turns off the twelfth transistor (T12) to stop the twelfth transistor (T12) to charge the first node (Qb); and then the first capacitor C1 keeps the first node (Qb) and the pull-up node (Qa) at the first electrical level to keep the third transistor (T3) off, the second capacitor C2 keeps the second node (P) at the second electrical level to keep the fourth transistor (T4) on, and the output end (G(N)) keeps at the first electrical level accordingly.

12. The display panel according to claim 11, wherein one of the forward scan signal (U2D) and the backward scan signal (D2U) is at a high level, another one of them is at a low level;

when scanning forward, the output end G(N−1) of the previous stage GOA unit controls the first transistor (T1) to turn on, and a gate of a first transistor (T1) of a first stage GOA unit is connected to a starting signal (STV); and when scanning backward, the output end (G(N+1)) of the next stage GOA unit controls the second transistor (T2) to turn on, and a gate of a second transistor (T2) of a last stage GOA unit is connected to the starting signal (STV).

13. The display panel according to claim 11, wherein all transistors in the GOA circuit are N-type thin film transistors, the first electrical level is a constant low level (VGL), and the second electrical level is a constant high level (VGH);

in the reset phase, the reset signal (Reset) provides a single high-level pulse signal to make the second node (P) at a high level, and the first node (Qb), the pull-up node (Qa), the third node (K), the forward scan signal (U2D), the backward scan signal (D2U), the Nth clock signal (CK(N)), the (N+1)th clock signal (CK(N+1)), the output end (G(N)), the output end (G(N−1)) of the previous stage GOA unit, and the output end G(N+1) of the next stage GOA unit all are at a low level;

in the pre-charge sub-phase (t1) of the normal display phase, the forward scan signal (U2D) is at the constant high level (VGH) and the backward scan signal (D2U) is at the constant low level (VGL) when scanning forward, the forward scan signal (U2D) is at the constant low level (VGL) and the backward scan signal (D2U) is at the constant high level (VGH) when scanning backward, the second node (P), the Nth clock signal (CK(N)), the (N+1)th clock signal CK(N+1), the output end (G(N)), and the output end G(N+1) of the next stage GOA unit all are at the low level, and the output end G(N−1) of the previous stage GOA unit, the first node (Qb), the pull-up node (Qa), and the third node (K) all are at the high level;

in the output sub-phase (t2) of the normal display phase, the second node (P), the (N+1)th clock signal (CK(N+1)), the output end (G(N−1)) of the previous stage GOA unit, and the output end (G(N+1)) of the next stage GOA unit all are at the low level, and the first node (Qb), the pull-up node (Qa), the third node (K), the Nth clock signal (CK(N)), and the output end (G(N)) all are at the high level; and in the pull-down sub-phase (t3) of the normal display phase, the first node (Qb), the pull-up node (Qa), the third node (K), the Nth clock signal (CK(N)), the output end (G(N)), and the output end (G(N−1)) of the previous stage GOA unit all are at the low level, and the second node (P), the (N+1)th clock signal (CK(N+1)), and the output end (G(N+1)) of the next stage GOA unit all are at the high level.

14. The display panel according to claim 11, wherein the GOA unit further comprises an output control module (900), the output control module (900) comprises an eighth transistor (T8), a gate of the eighth transistor (T8) is connected to a global control signal (GAS), a source of the eighth transistor (T8) is connected to the first electrical level, and a drain of the eighth transistor (T8) is electrically connected to the output end (G(N)).

15. The display panel according to claim 14, wherein the GOA circuit further comprises a touch scan phase after the normal display phase; and in the touch scan phase, the global control signal (GAS) controls output ends (G(N)) of all stages of the GOA units to change to the first electrical level.

16. The display panel according to claim 15, wherein all transistors in the GOA circuit are N-type thin film transistors, the global control signal (GAS) is at the low level in both the reset phase and the normal display phase, and at the high level in the touch scan phase.

17. The display panel according to claim 15, wherein all clock signals are periodic pulse signals in the reset phase and the normal display phase, and all the clock signals are pulse signals synchronized with a touch scan signal in frequency in the touch scan phase.

18. The display panel according to claim 17, wherein the GOA circuit comprises a first clock signal (CK1) and a second clock signal (CK2), when the Nth clock signal (CK(N)) is the first clock signal (CK1) and the (N+1)th clock signal (CK(N+1)) is the second signal (CK2), in the reset phase and the normal display phase, a period of the first clock signal (CK1) and a period of the second clock signal (CK2) are the same, and a pulse signal of the next clock signal starts when a pulse signal of the previous clock signal is ending.

* * * * *